US006883229B2

(12) United States Patent
Schuppert, Jr.

(10) Patent No.: US 6,883,229 B2
(45) Date of Patent: Apr. 26, 2005

(54) METHOD AND APPARATUS FOR ASSEMBLING CONTACT SHIELD AND STRAIN RELIEF TO A CABLE

(75) Inventor: Leo Vincent Schuppert, Jr., York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 34 days.

(21) Appl. No.: 10/400,709

(22) Filed: Mar. 27, 2003

(65) Prior Publication Data

US 2004/0187299 A1 Sep. 30, 2004

(51) Int. Cl.[7] ..... H01R 43/20

(52) U.S. Cl. ..... 29/747; 29/33 M; 29/748; 29/884

(58) Field of Search ..... 29/33 M, 747, 29/863, 884, 748, 753, 564.6

(56) References Cited

U.S. PATENT DOCUMENTS 4,214,361 A * 7/1980 Coldren et al. ..... 29/863
4,821,383 A * 4/1989 Grosklos et al. ..... 29/33 M
5,355,582 A * 10/1994 Saito et al. ..... 29/863
5,564,613 A * 10/1996 Baldyga ..... 242/615.3
5,575,061 A * 11/1996 Tsuji et al. ..... 29/863

* cited by examiner

*Primary Examiner*—Carl J. Arbes

(57) ABSTRACT

An assembly is provided for loading a contact shield and a strain relief onto a dielectric member on an end of a cable having a center conductor surrounded by insulation. The assembly includes a strip guide for conveying a contact shield along a carrier path to a loading station. The contact shield is joined to a carrier strip. A holder is provided at the loading station to hold the dielectric member on the end of the cable. A slider moves the holder to and from the loading station along a cable loading path. A shear assembly is also provided at the seating station to remove the contact shield and strain relief from the carrier strip and seat the contact shield and strain relief along a seating path with the dielectric member. Optionally, the shearing assembly may include first and second shears for separately removing a strain relief and the contact shield, respectively, from the carrier strip. The first and second shears may be staged different first and second distances from the holder to successively engage the holder in a staggered manner. Optionally, the strip guide and slider may be mounted adjacent to one another to a base plate with the slider being movable relative to the base plate along the cable loading path and the strip guide being movable relative to the base plate along the loading path.

23 Claims, 10 Drawing Sheets

METHOD AND APPARATUS FOR ASSEMBLING CONTACT SHIELD AND STRAIN RELIEF TO A CABLE

BACKGROUND OF THE INVENTION

The present invention generally relates to a method and apparatus for assembling connectors to a cable and more specifically, a machine for semi-automatic assembly of contact shields and connector strain reliefs to cables.

Cable assemblies convey data or power signals between systems and components through numerous types of connectors that are attached to opposite ends of the cable. The cables are constructed in a variety of sizes and lengths, as well as in a variety of wire configurations (e.g., coaxial, twisted pair, single conductor, and the like). The cables are terminated at opposite ends by connectors that also are constructed in a variety of shapes and sizes depending in part on the size, length and configuration of the cable.

Many connectors include at least one contact joined to a conductor within the cable with the contact surrounded by a shield. The shield is separated from the contact by a dielectric member that holds the contact and shield in a know and desired relation to one another. Exemplary connectors of the foregoing type are described in U.S. patent applications Ser. Nos. 10/005,625, 10/004,979, 10/037,185, titled "Coaxial Cable Connector", "Coaxial Cable Displacement Contact" and "Strain Relief For Electrical Cable" and filed on Dec. 5, 2001, Dec. 5, 2001 and Jan. 4, 2002, respectively, which are incorporated herein in their entirety by reference. The foregoing applications are assigned to the assignee of the present application.

During assembly, cables are terminated at opposite ends with the connectors. It is desirable to automate the assembly process as fully as possible to reduce the manufacturing time and cost. The degree to which the assembly process can be automated is dependant in part on the complexity of the cable and connector. Heretofore, a labor intensive assembly process was required in particular for connectors that include shielding separated from the contacts by a dielectric member. The manual labor involved in assembly of these connectors is extensive due in part to the desire to maintain a particular spacing and relation between the contact and the shield.

Further, many types of connectors include a strain relief that is configured to transfer stress and strain from the jacket of the cable directly to the connector housing. The strain relief reduces the forces experienced at the connection between the contact(s) in the connector and the conductor(s) of the cable. These forces are present when the cable is pulled, bent or moved. During the cable assembly process, connectors having a strain relief may require an additional step to join the strain relief to the cable depending upon the structure of the strain relief and of the overall connector.

A need exists for a semi-automated method and apparatus for assembling a cable with a connector having a contact shield and/or a strain relief.

BRIEF DESCRIPTION OF THE INVENTION

An assembly is provided in accordance with one embodiment for loading at least one of a contact shield and strain relief onto an end of a cable having a center conductor surrounded by insulation. The assembly includes a strip guide for conveying a contact shield and/or strain relief along a carrier path to a loading station. A holder is provided at the loading station and is configured to hold a dielectric member on an end of the cable. A shear assembly is also provided at the loading station to remove the contact shield and/or strain relief from the carrier strip. The shear assembly also seats the contact shield and/or strain relief along a seating path with the dielectric member.

Optionally, the shear assembly may include an upper shear that is movable along a shearing path that is oriented at an angle to the carrier path. Optionally, the shear assembly may include first and second shears for separately removing a strain relief and a contact shield respectively, from the carrier strip. The first and second shears may be staged different first and second distances from the holder and may be movable together toward the holder to successively engage lower shears on the holder in a staggered manner.

Optionally, the strip guide may include a track configured to convey a series of contact shields joined to the carrier strip along the carrier path. Optionally, the strip guide may be movable relative to the base plate along the shearing path.

In accordance with an alternative embodiment, a method is provided for loading a contact shield and a strain relief onto an electrical cable. The method includes placing a cable with a dielectric member thereon at a loading station. A carrier strip holding a plurality of contact shields and strain reliefs is fed to the loading station until one of the contact shields and one of the strain reliefs are centered over the top of the dielectric member. The strain relief and contact shield are seated into the dielectric member and the strain relief and contact shield are sheared from the carrier strip separately and in succession.

Optionally, the seating step may include pressing the contact shield and strain relief by different depths into the dielectric member. Optionally, the feed step may include feeding the carrier strip along a carrier feed path that is oriented perpendicular to a length of the dielectric member. Optionally, the shearing step may include cutting the strain relief from the carrier strip first and thereafter cutting the contact shield from the carrier strip. Optionally, the shearing strip may occur during the seating step such that the contact shield and strain relief are partially seated in the dielectric member before being separated from the carrier strip.

DETAILED DESCRIPTION OF THE INVENTION

Figure 1:
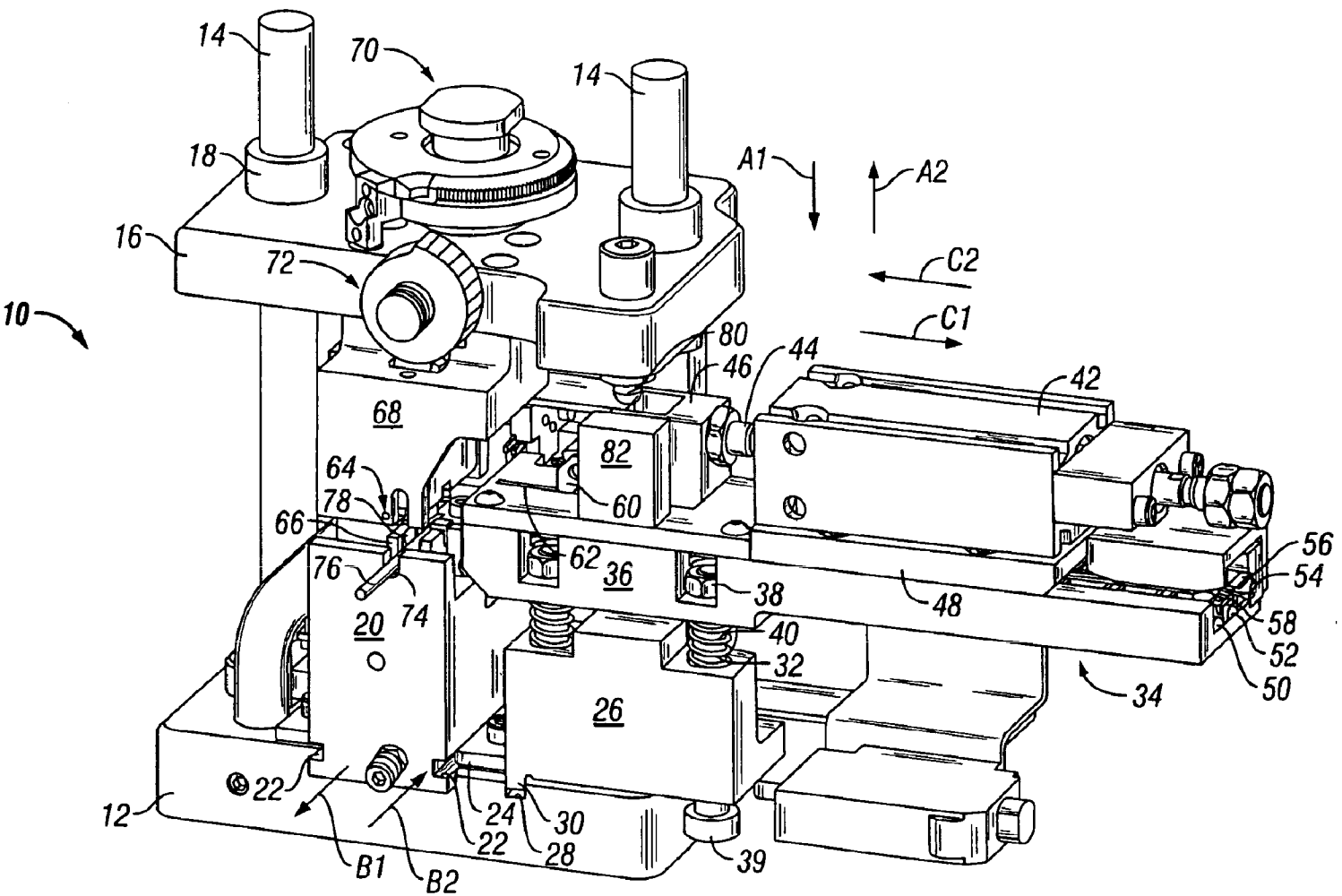
FIG. 1 illustrates an isometric view of a machine formed in accordance with an embodiment of the present invention.

FIG. 1 illustrates an isometric view of a machine 10 formed in accordance with an embodiment of the present invention. The machine 10 includes a base plate 12 having support posts 14 secured thereto and extending perpendicularly upward from the base plate 12. The support posts 14 receive a top plate 16. During the loading or seating operation, the top plate 12 slides downward and upward in the directions of Arrow A1 and A2 along the support posts 14 at sleeves 18. The tope plate 16 is driven upward and downward by a power source (not shown), such as hydraulic or pneumatic cylinders, a mechanical screw shafts, an electric solenoid, a manually pry handle and the like. The base plate 12 holds a slide block 20 that is manually or electrically movable in the directions denoted by Arrows B1 and B2. The slide block 20 includes notches 22 on opposite sides thereof that slide along guideplates 24 that are secured to the base plate 12. The guide plates 24 direct the slide block 20 along a particular path and orientation with respect to the base plate 12.

A guide support block 26 is mounted to the base plate 12 and is located in a particular alignment through cooperation of a notch 28 and flange 30 formed in the base plate 12 and guide support block 26, respectively. The guide support block 26 retains multiple bolts 32 extending upward therethrough. The bolts 32 support a strip guide 34. Optionally, the bolts 32 may extend through holes formed in a body portion 36 of the strip guide 34. Nuts 38 retain the strip guide 34 on the bolts 32 and definite an upper limit for the range of motion of the strip guide 34. Springs 40 are provided on the bolts 32 and are positioned between the upper surface of the guide support block 26 and the bottom surface of the body portion 36 of the strip guide 34. The springs 40 exert sufficient upward force to maintain the strip guide 34 in its uppermost position limited by the head of shoulder screw 39 resting on the under side of guide support block 26. As explained below in more detail, the strip guide 34 moves downward parallel to the direction of Arrow A1 during the loading operation, which includes shearing and seating stages. Optionally, the strip guide 34 may move downward until abutting against the top surface of the guide support block 26.

Optionally, the bolts 32 may be securely attached to the strip guide 34 and slidably received within channels cut through the guide support block 26. In this alternative embodiment, the bolts 32 slide up and down within the guide support block 26. Heads 39 on the bolts 38 limit the upward range of motion of the strip guide 34.

The strip guide 34 has a cylinder 42 mounted thereon. The cylinder 42 may be hydraulic, pneumatic, electric or otherwise. The cylinder 42 includes a piston 44 that is movable along the path denoted by Arrows C1 and C2 to move a U-shaped bracket 46 between extended and retracted positions. The cylinder 42 is secured to the upper surface of the strip guide 34 at a support plate 48. The support plate 48 may be adjustably positioned along the length of the strip guide 34 to achieve a desired position for the cylinder 42. A block at a rear of the cylinder 42, which the rod passes through, limits the feed stroke in general with a fine adjustment provided by the positioning of two nuts on the rod end. The strip guide 34 includes a channel 50 formed therethrough and extending along its length. The channel 50 includes a central rib 52 that extends along the length of the channel 50. The rib 52 includes a contoured exterior that is configured to carry a carrier strip 54 that has a plurality of contact shields 56 and strain reliefs 58 formed integrally therewith. The carrier strip 54 is conveyed along the top surface of the rib 52 to convey the contact shield 56 and strain relief 58 along the channel 50 on opposite sides of the rib 52.

The U-bracket 46 on the end of the cylinder 42 engages a feed finger 60 and moves the feed finger 60 along a slot 62. A lower end of the feed finger 60 (not shown in FIG. 1) engages the carrier strip 54 (as explained below in more detail) and advances the carrier strip 54 in the direction of Arrow C1 along the strip guide 34. The feed finger 60 advances the carrier strip 54 (and consequently the contact shields 56 and train reliefs 58) successively and automatically to a loading station generally denoted by reference number 64.

Figure 2:
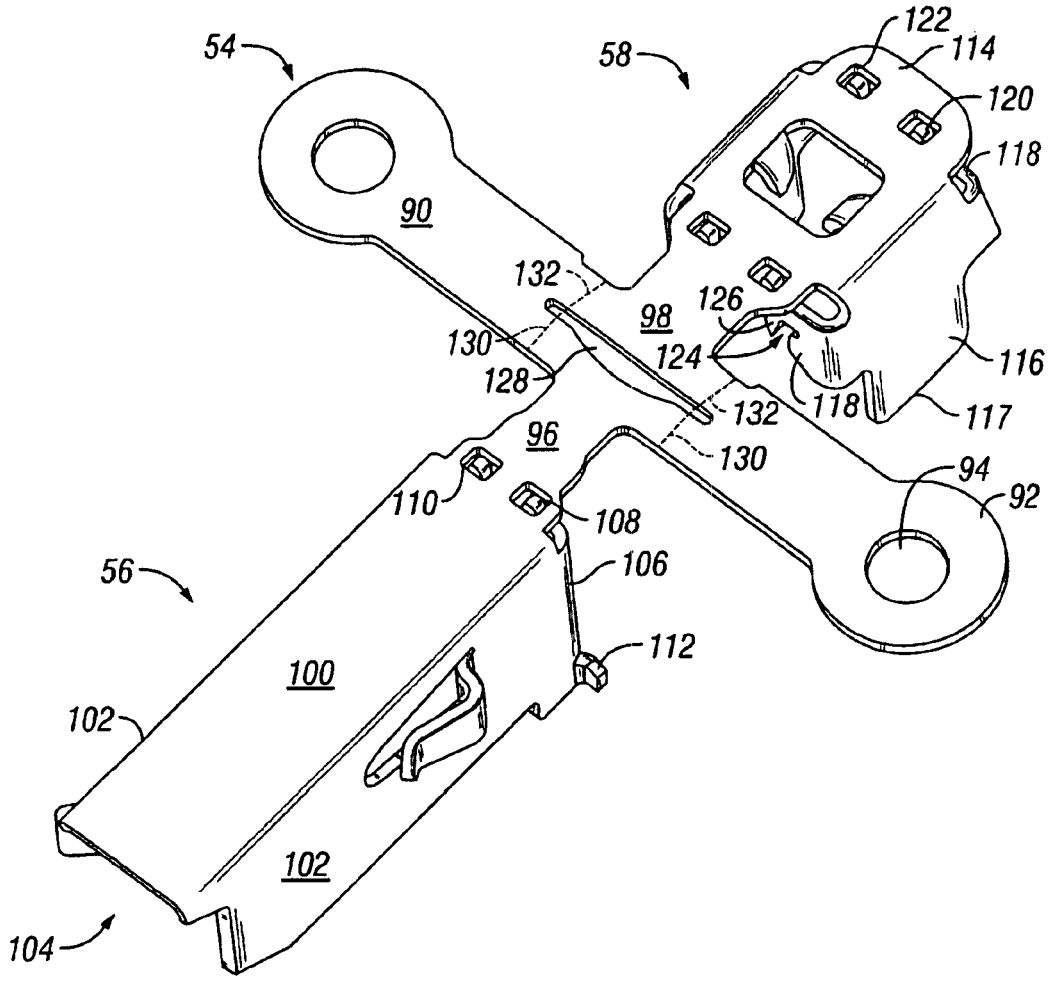
FIG. 2 illustrates an isometric view of a portion of a carrier strip with a contact shield and strain relief attached thereto.
Figure 3:
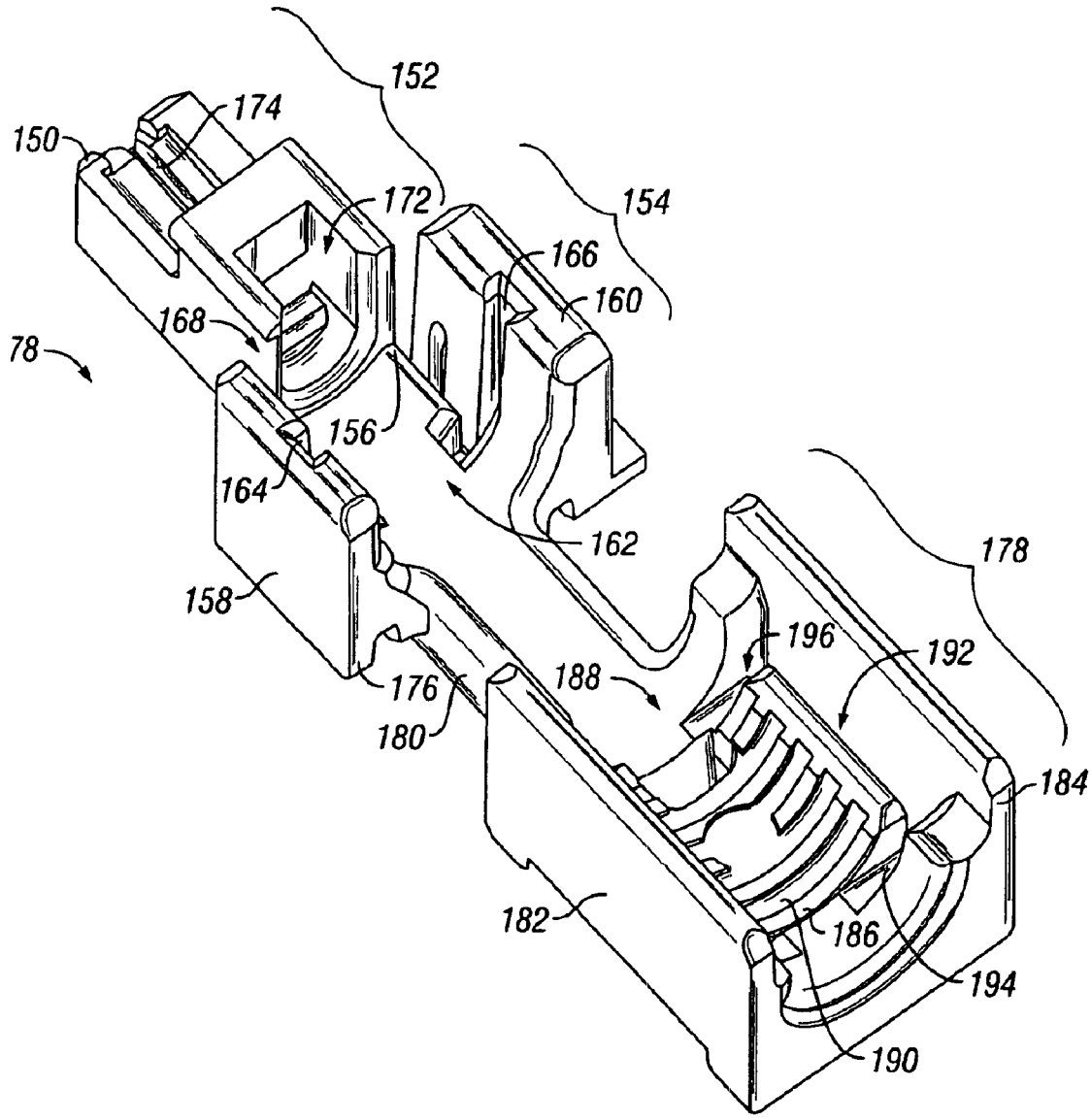
FIG. 3 illustrates an isometric view of a dielectric member used during assembly of connectors within the machine of FIG. 1.

As used throughout, the term "load" or "loading" shall generally refer to any or all of the operations carried out at the loading station 64, including either or both a shearing operation and a seating operation. The term "shear" or "shearing" shall refer to the process by which the carrier strip 54 is separated from one or both of the contact shield 56 and strain relief 58 (FIG. 2). The term "seat" or "seating" shall refer to the process by which one or both of the contact shield 56 and strain relief 58 are joined to the cable 76 and/or the dielectric member 78 (FIG. 3).

A holder 66 is provided at the loading station 64 and is supported by the slide block 20 at a specific position and orientation within the machine 10. The holder 66 is oriented with an open face directed upward toward a shear assembly 68 that is mounted to the top plate 16. The shear assembly 68 includes depth adjusters 70 and 72 which are configured to control the depth to which each contact shield 56 and strain relief 58 is seated within a dielectric member 78 held in the holder 66. The depth adjusters 70 and 72 may be manually or electrically operated. As shown in FIG. 1, the depth adjusters 70 and 72 are rotated manually. The depth adjusters 70 and 72 also control the order in which the contact shield 56 and strain relief 58 are separated from the carrier strip 54, as well as the time between separation of a contact shield 56 and associated strain relief 58.

The slide block 20 includes a notch 74 cut in a side thereof to accept a cable 76 that extends into the holder 66 and that is terminated within a dielectric member 78 placed in the holder 66.

The top plate 16 also includes a spring plunger 80 projecting downward from the bottom surface of the top plate 16. The plunger 80 is aligned with a push block 82 that is mounted on the strip guide 34. During an assembly operation, when the top plate 16 is moved downward (such as by a cylinder that is not shown), the plunger 80 engages the push block 82 to push the strip guide 34 downward along bolts 32. Once the top plate 16 is moved to the end of its range of motion (e.g., a loading operation is completed), it is moved upward. The springs 40 force the strip guide 34 upward until reaching a limit determined by the position of nuts 38. Alternatively, the bolts 32 may be secured to the strip guide 34 with lower ends of the bolts 32 slidably received within the guide support block 26. Hence, when the strip guide 34 is pressed downward by the plunger 80, the bolts 32 move downward within the guide support block 26.

FIG. 2 illustrates an isometric view of a portion of the carrier strip 54 along with a contact shield 56 and strain relief 58 mounted thereon. The carrier strip 54 includes a main band 90 having enlarged rings 92 stamped therewith and holes 94 punched through the rings 92. The band 90 is continuous with rings 92 separating each combination of a contact shield 56 and strain relief 58. The band 90 is conveyed along the top surface of the rib 52 (FIG. 1) as the carrier strip 54 is advanced through the channel 50 and the strip guide 34.

Each contact shield 56 and strain relief 58 is formed integrally with the band 90 at linking segments 96 and 98, respectively. Linking segment 96 is formed with a top wall 100 of the contact shield 56. Opposite edges of the top wall 100 are formed with side walls 102 that are bend downward from the top wall 100 to form a U-shaped channel 104. Rear ends of the side walls 102 are bent inward toward one another to form an insulation displacement contact 106 (IDC). The IDC 106 includes upper tips 108 that are received in holes 110 in the top wall 100 to hold the IDC 106 in place. A lateral ear 112 is provided at the bend where the IDC 106 and side wall 102 are joined. The ears 112 extend outward from opposite side walls 102 and cooperate with associated features in the dielectric member 78 (explained below in more detail) to locate the contact shield 56 at a particular position along the length of the dielectric member 78.

The strain relief 58 also includes a top wall 114 that is joined along opposite sides with legs 116 which extend downward parallel to one another. Opposite sides of each leg 116 are joined with cable grips 118 that are bent inward towards one another. The cable grips 118 include tips 120 that are received within holes 122 formed in the top wall 114. The cable grips 118 include notches 124 and teeth 126 that are configured to pierce the cable 76 when the strain relief 58 is seated.

The band 90 of the carrier strip 54 includes a slot 128 cut therein and oriented to extend along a portion of the length of the carrier strip 54 between contact shield 56 and strain relief 58. The slot 128 separates the linking segments 96 and 98. During an assembly operation, the shear assembly 68 (FIG. 1) cuts the linking segment 96 from the band 90 at shear lines 130 and separately cuts the linking segment 98 from the band 90 at shear lines 132. Optionally, shear lines 130 may, but need not, align with shear lines 132. According to one embodiment, the linking segment 98 is separated from the band 90 before the linking segment 96 is separated from the band 90. Alternatively, the order in which the linking segments 96 and 98 are separated from the band 90 may be reversed. As a further alternative, the linking segments 96 and 98 may simultaneously be separated from the band 90 with a common shear, or with separate and distinct shearing assemblies.

FIG. 3 illustrates an isometric view of the dielectric member 78 used in accordance with an embodiment of the present invention. The dielectric member 78 includes a mating face 150 formed on a front end of a rectangular body section 152. A rear end of the body section 152 is formed with a shroud 154 through a joining section 156. The shroud 154 includes opposed side walls 158 and 160 cooperating to define a U-shaped chamber 162 there between that receive the cable 76. Interior surfaces of the side walls 158 and 160 include notches 164 and 166, respectively, facing one another and extending vertically in a plane transverse to a length of the dielectric member 78. The notches 164 and 166 receive the ears 112 on the contact shield 56 (FIG. 2) extending outward from opposite side walls 102. The body section 152 has a lesser width than the distance between interior surfaces of the side walls 158 and 160 to form passages 168 between the shroud 154 and opposite exterior surfaces of the body section 152. The side walls 102 of the contact shield 56 (FIG. 2) are received within the passages 168 when the contact shield 56 is seated on the dielectric member 78.

The body section 152 includes a chamber 172 adapted to receive a leading end of a cable 76 (FIG. 1), along with a crimp that secures a contact to the conductive member within the cable. The contact (not shown) on the end of the cable 76 is loaded through the chamber 172 into the slot 174 formed in the body section 152.

A rear end 176 of the shroud 154 is joined with a cable support member 178 through a linking member 180. The cable support member 178 includes side walls 182 and 184 and a bottom wall 186 that collectively define a U-shaped notch 188. The bottom wall 186 includes transverse grooves 190 formed therein. Intermediate portions of the bottom wall 186 are separated from the side walls 182 and 184 by channels 192 which extend through the cable support member 178. The channels 192 are spaced apart to align with, and receive, the legs 116 (FIG. 2) formed on the strain relief 58. Transverse notches 194 and 196 are formed in the cable support member 178 proximate front and rear ends thereof. The notches 194 and 196 receive the cable grips 118 (FIG. 2) that extend inward towards one another from the legs 116 of the strain relief 58.

During an assembly operation, as the strain relief 58 is seated in the dielectric member 78 at the loading station 64 (FIG. 1), the teeth 126 on the cable grip 118 pierce the jacket of the cable (and engage an outer conductor if present). The cable grip 118 secures the strain relief 58 to the cable 76 and prevents relative axial motion there between. The cable grip 118 resists axial movement between the cable 76 and the dielectric member 78 without deforming the circular cross section of the cable 76. The cable grip 58 and dielectric member 78 minimize deformation of the cable 76 into any geometry other than the cable's normal cross section.

Figure 4:
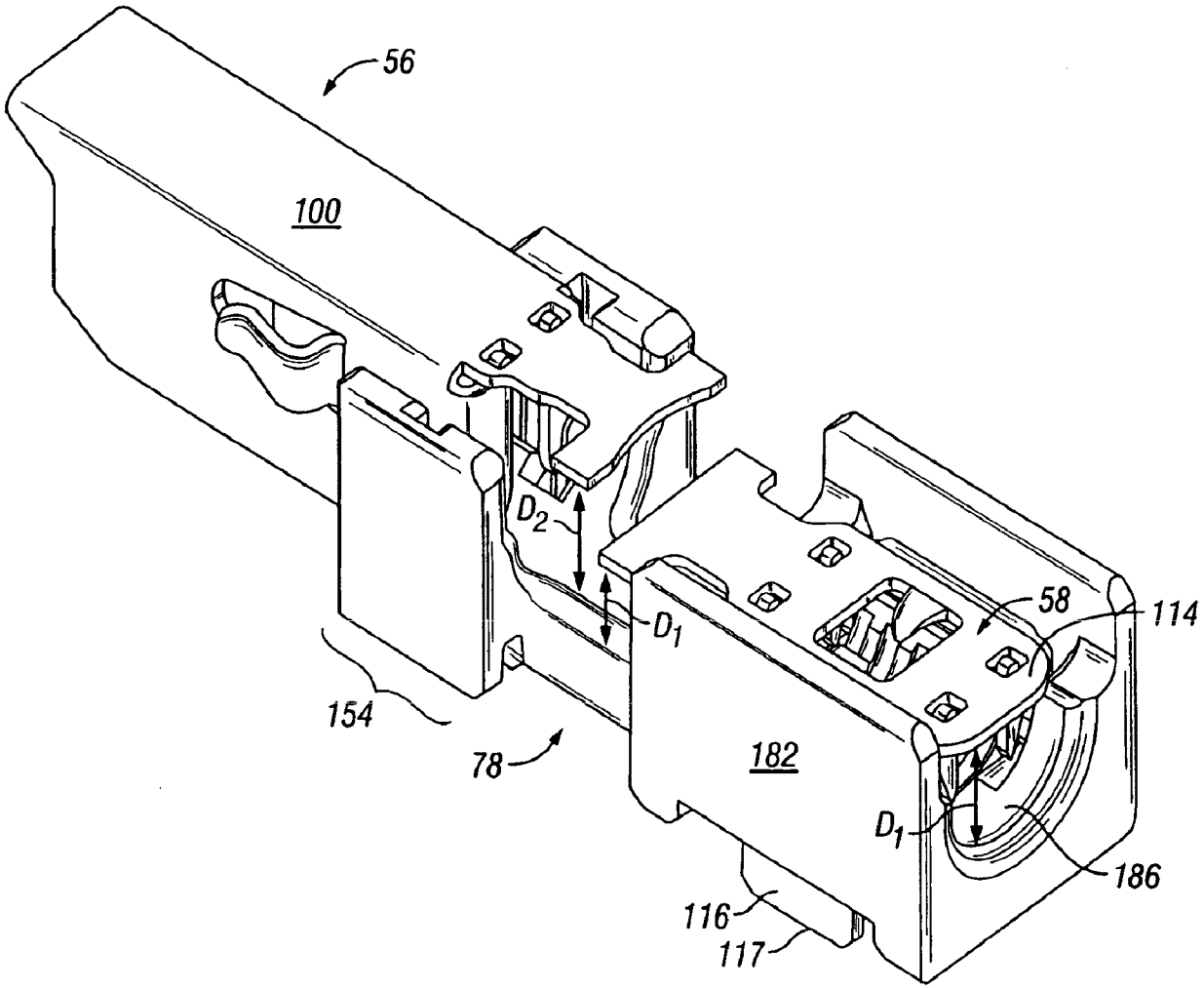
FIG. 4 illustrates a dielectric member with a contact shield and strain relief seated therein.

FIG. 4 illustrates an isometric view of the dielectric member 78 separately seated with a strain relief 58 and a contact shield 56. As shown in FIG. 4, when the contact shield 56 and strain relief 58 are fully seated within the dielectric member 78, they are positioned at different depths. More specifically, the strain relief 58 is seated to a distance D1 measured between the interior of the bottom wall 186 of the cable support member 178 and the interior surface of the top wall 114 of the strain relief 58. The contact shield 56 is seated to a distance D2 which extends between the interior surface of the bottom of the shroud 154 and the interior surface of the top wall 100 of the contact shield 56. As shows in FIG. 4, the distances D1 and D2 differ.

Figure 5:
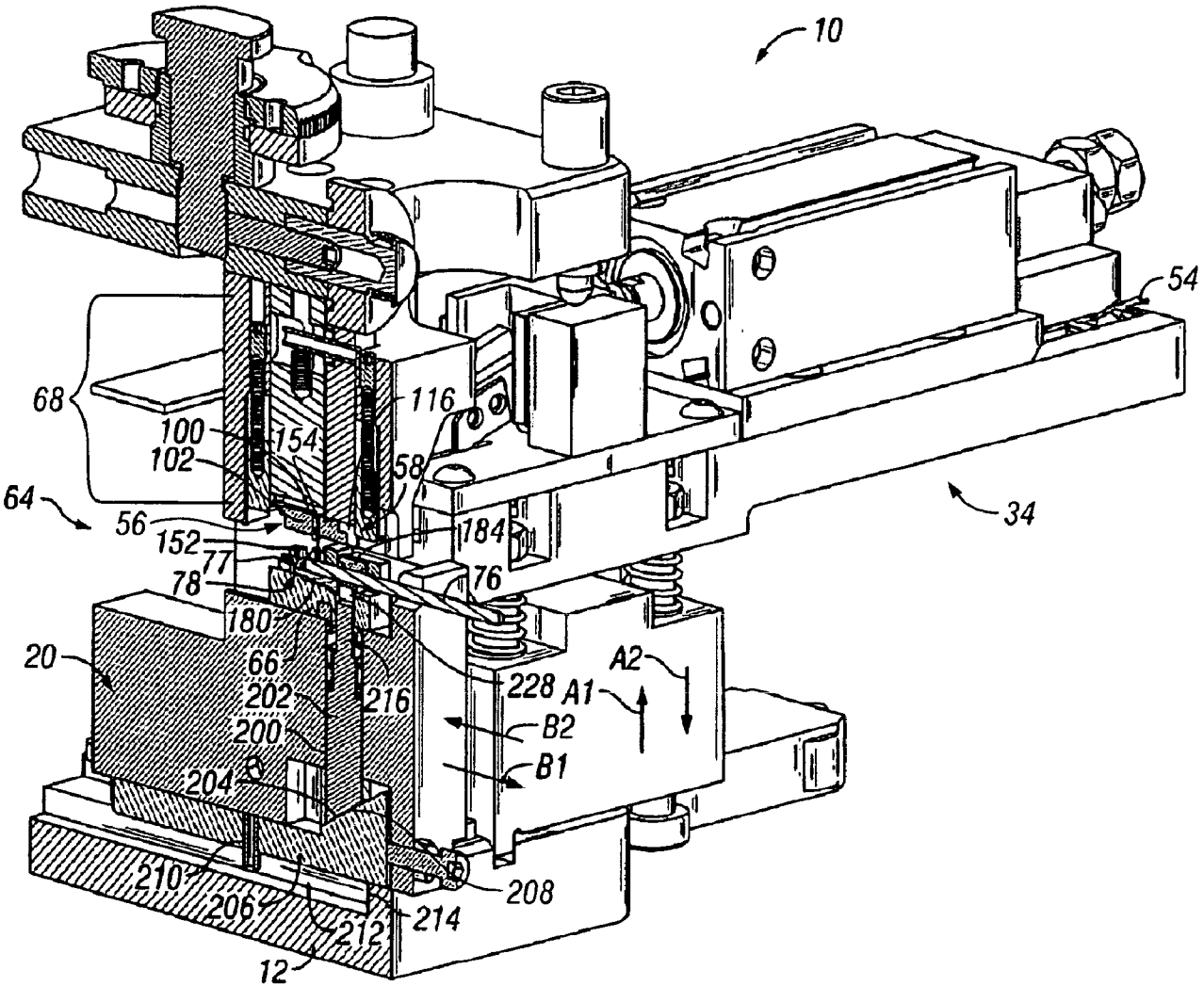
FIG. 5 illustrates a partial cutaway view of the machine in FIG. 1 when loaded and at an initial staging position.

FIG. 5 illustrates a cut away isometric view of the machine 10 through the loading station 64 to better illustrate the components therein and the shearing and seating operations. The slide block 20 is positioned in the closed position to locate the holder 66 below the shear assembly 68. The slide block 20 includes a vertical channel 200 cut therethrough which receives a cylindrical clinch tool 202. The clinch tool 202 has a sloped lower edge 204 that rides on a cam member 206. The cam member 206 has a ramped surface 208 that joins the lower edge 204 of the clinch tool 202. A pin 210 extends downward from the cam member 206 and slides within a channel 212 formed in the base plate 12.

During the cable loading step of an assembly operation, the slide block 20 is opened or pulled outward by an operator in the direction of Arrow B1. The cam member 206 also sliding outward in the direction of Arrow B1 until the pin 210 abuts wall 214 at the end of the channel 212. When the pin 210 engages the wall 214, the cam member 206 stops sliding even though the operator continues pulling the slide block 20 outward in the direction of Arrow B1. As the slide block 20 continues to move outward, the clinch tool 202 rides upward along the ramp surface 208 of the cam member 206 causing the upper end 216 of the clinch tool 202 to move upward through the holder 66. As the upper end 216 of the clinch tool 202 is forced upward in the direction of Arrow A1, the clinch tool 202 forcibly ejects a completed sub-assembly which comprises the dielectric member 78 and cable 76 fully seated with a contact shield 56 and strain relief 58. Thereafter, a new dielectric member 78 and cable 76 are loaded into the holder 66 and the slide block 20 is closed in the direction of Arrow B2 back to the loading station 64. As the lower edge 204 of the clinch tool 202 rides downward along the cam member 206, the upper end 216 travels downward in the direction of Arrow A2 until reaching the position shown in FIG. 5.

The upper end 216 of the clinch tool 202 is formed with a pair of clinch guides 228 that are configured to engage the legs 116 on the strain relief 58. The clinch guides 228 bend the legs 116 inward toward one another about the bottom of the cable support member 178 as the strain relief 58 is fully seated within the cable support member 178.

Figure 6:
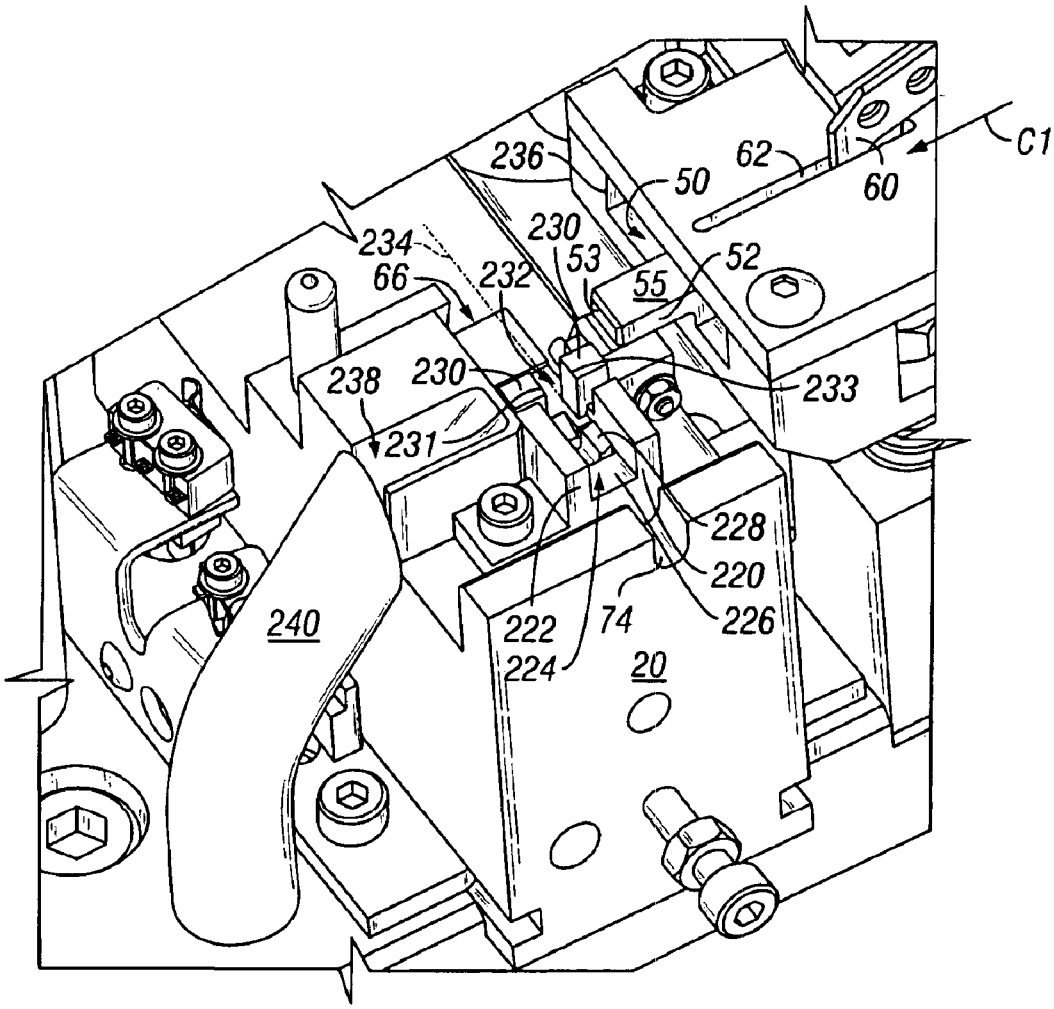
FIG. 6 illustrates a top isometric view of the loading station within the machine in FIG. 1.

FIG. 6 illustrates the slide block 20 and holder 66 in more detail. The holder 66 includes side arms 220 and 222 arranged parallel to one another and spaced apart to form a tooling nest 224 therebetween. The tooling nest 224 includes a bottom surface 226 having a hole therethrough that receives the clinch guides 228 formed on the upper end 216 of the clinch tool 202 (FIG. 5). The clinch guides 228 are provided adjacent one another and in facing relation to one another. The holder 66 further includes posts 230 that are provided proximate the side walls 220 and 222. The posts 230 are separated by a gap 232 that is narrower than the distance between the side walls 220 and 222.

When a dielectric member 78 is loaded into the holder 66. the cable support member 178 of the dielectric member 78 is positioned between the side walls 220 and 222. With reference to the dielectric member 78 in FIG. 3, the linking member 180 is received in the gap 232, while the posts 230 fit between the shroud 154 and cable support member 178. The dimensions and spacing of the posts 230 and gap 232 orient the dielectric member 178 at a desired position along the longitudinal axis 234 (FIG. 6) of the holder 66. The posts 230 and side walls 220 and 222 laterally position the dielectric member 78 at a desired position transverse to the longitudinal axis 234.

FIG. 6 also illustrates a discharge end 236 of the channel 50 in the strip guide 34, through which the carrier strip 54 (FIG. 1) is advanced to the holder 66. The rib 52 extends beyond the discharge end 236 in order to properly guide the carrier strip 54 to its final position prior to the seating step. For example, an outer end 53 of the rib 52 may be located proximate a vertical plane defined by, and extending through, one of posts 230 and the side wall 220 of the holder 66. The length and position of the outer end 53 is dependent in part on the length of the bands 90 (FIG. 2) that separate adjacent contact shields 56 and adjacent strain reliefs 58. Portion 55 of the rib 52 holds one band 90 while an outermost band 90 extends beyond the outer end 53 to suspend a contact shield 56 and strain relief 58 over the open face of the holder 66.

The feed finger 60 advances along slot 62 until a contact shield 56 and strain relief 58 (FIG. 2) are suspended by the carrier strip 54 directly above the open face of the holder 66. This position, the legs 116 of the strain relief 58 are aligned to slide into channels 192 in the cable support member 178 (FIG. 3) which is held between interior surfaces of the side walls 220 and 222. The legs 116 fit along interior surfaces of the side walls 182 and 184 on the cable support member 178 and align with the clinch guides 228. When the strain relief 58 is seated fully with the dielectric member 78, the clinch guides 228 bend the outer ends 117 of the legs 116 inward toward one another to enclose and securely grip the bottom of the cable support member 178.

Upon completion of a loading operation, a waste portion of the carrier strip 54 remains. This waste portion is discarded into a waste receptacle 238 and removed from the machine 10 through a pipe 240.

Returning to FIG. 5, attention is directed to the loading station 64, where the cut away view illustrates a length-wise portion of a dielectric member 78 with one side wall 184 located behind a cable 76. The linking member 180 and bottom portions of the shroud 154 and of the body section 152 are apparent in FIG. 5 below the cable 76. A contact 77 is shown on the end of the center conductor of the cable 76.

The cut away view of FIG. 5 also illustrates a length-wise portion of a contact shield 56 and strain relief 58. A leg 116 of a strain relief 58 is suspended over and aligned with the side wall 184 of the dielectric member 78. The side wall 102 of the contact shield 56 extends down from the top wall 100. The side wall 102 is aligned to cover the body section 152 and shroud 154 on the dielectric member 78 when fully seated.

Figure 7:
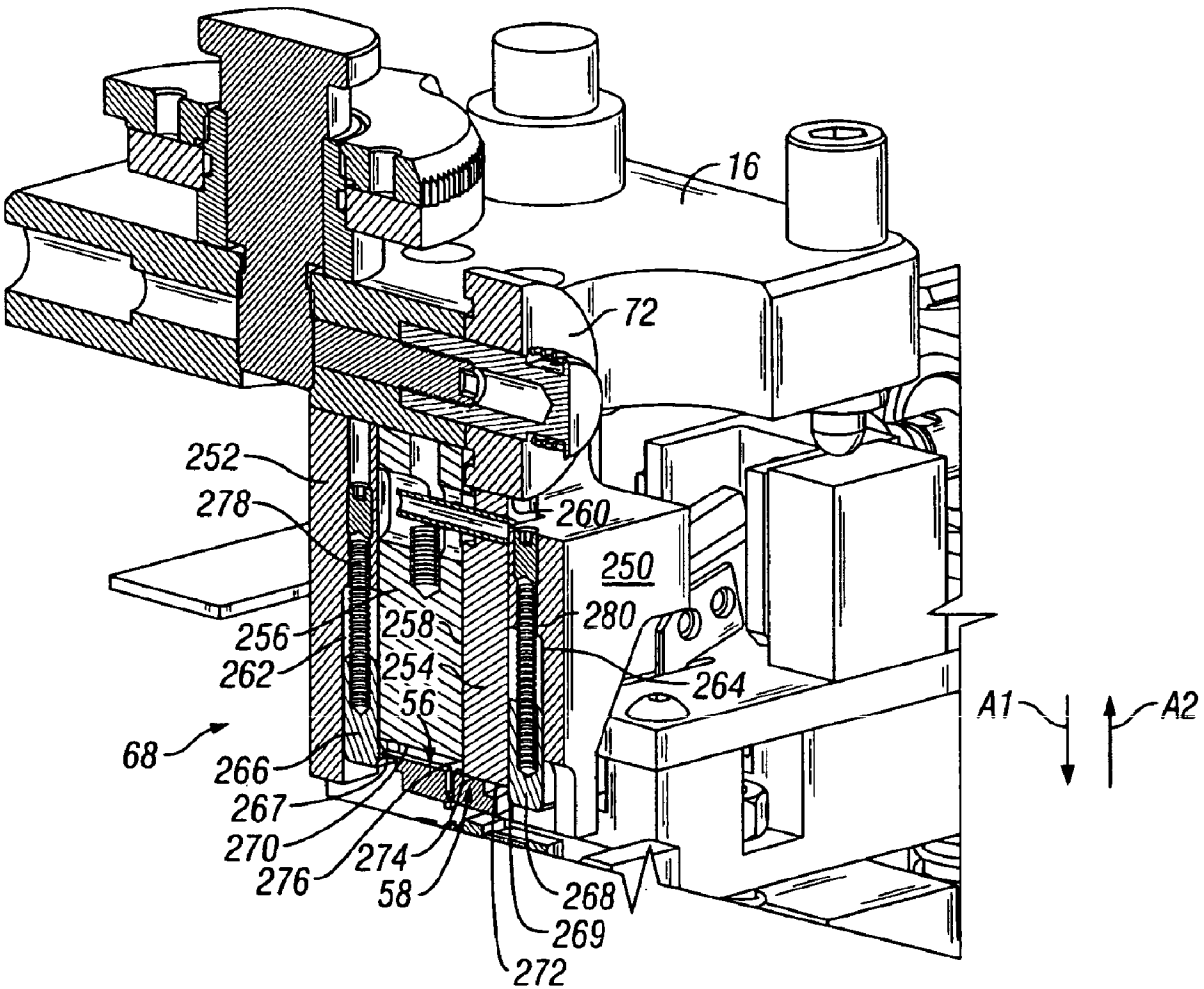
FIG. 7 illustrates a cutaway view of the shearing assembly of the machine of FIG. 1.

FIG. 7 illustrates a partial cutaway view of the shear assembly 68 as mounted to the top plate 16. The shear assembly 68 includes front and rear brackets 250 and 252 that collectively define a frame that is attached to the top plate 16. A chamber is formed between the front and rear brackets 250 and 252 which receives strain relief shear 254 and shield shear 256. The strain relief and shield shears 254 and 256 are provided immediately adjacent to one another and in abutting relation along a shear interface 258. The strain relief and shield shears 254 and 256 include shearing edges 274 and 276, respectively, which are staggered with respect to one another along the shearing path denoted by Arrow A1. The shield shear 256 is securely held against the bottom surface of the top plate 16 in a fixed relation. The strain relief shear 254 includes an upper end 260 that rests against the depth adjuster 72. The depth adjuster 72 includes a cammed exterior surface. As the depth adjuster 72 is rotated, the exterior tangential portion thereof that abuts against the upper end 260 of the strain relief shear 254, moves further from or closer to the central rotational axis of the depth adjuster 72. Hence, the depth adjuster 72 affords the operator the ability to vary the relative position of the strain relief shear 254 with respect to the shield shear 256, thereby enabling the strain relief and shield shears 254 and 256 to operate in a staggered, successive manner. The depth adjuster 72 further enables the operator to adjust the depth to which the strain relief and shield shears 254 and 256 seat a strain relief 58 and a contact shield 56 (FIG. 4), respectively.

Cavities 262 and 264 are formed between the front and rear brackets 250 and 252 and the strain relief and shield shears 254 and 256, respectively. The cavities 262 and 264 receive locator blocks 266 and 268 that abut against exterior opposed surfaces of the strain relief and shield shears 254 and 256. The locator blocks 266 and 268 extend downward below the bottom surfaces 270 and 272 of the strain relief and shield shears 254 and 256. The positions of the locator blocks 266 and 268 are forced down by springs 278 and 280, respectively. The locator blocks 266 and 268 align the contact shield 56 and strain relief 58 as the locator blocks are lowered. The locating blocks 266 and 268 travel down guiding the contact shield 56 and the strain relief 58 into the dielectric member 78.

Next, a loading operation will be explained. The shear assembly 68 begins with the top plate 16 moved upward in the direction of arrow A2 to an initial shear staging position (FIG. 5). At this position, the shear assembly 68 is provided above the discharge end 236 (FIG. 6) of the channel 50 in the strip guide 34. The feed finger 60 advances the carrier strip 54 along the carrier path in the direction of arrow C2 as indicated on FIG. 1 until band 90 (FIG. 2) suspends a contact shield 56 and strain relief 58 above the open face on the holder 66. The process of advancing the carrier strip 54 is generally referred to as a carrier feed step which locates the contact shield 56 and the strain relief 58 at an initial shield/strain staging position.

Next, the shear assembly 68 is moved downward along the shearing path A1. The locator blocks 266 and 268 center the contact shield 56 and strain relief 58. As shown in FIG. 1, as the top plate 16 lowers the shear assembly 68, the plunger 80 engages the push block 82 which drives the strip guide 34 downward along the shearing path A1. Hence, the plunger 80 avoids undue downward pressure being placed on the carrier strip 54. The shear edge 274 of the strain relief shear 254 first engages the band 90 (FIG. 2) of the carrier strip 54 proximate the slot 128 (FIG. 2). By moving the strip guide 34 downward in this manner, the contact shield 56 and strain relief 58 are partially seated in the dielectric member 78 before being separated from the carrier strip 54. This affords added control over positioning and alignment.

The carrier strip 54 is lowered until it engages the posts 230 which serve as lower shears. The width of the gap 232 between the posts 230 is equal to the widths of the linking segments 96 and 98 as measured between the shear lines 130 and 132, respectively. More specifically, the posts 230 have lower shear edges 231 and 233 (FIG. 6) that engage the band 90 along shear lines 130 and 132. The shear edge 274 (FIG. 7) of the strain relief shear 254 passes downward into the gap 232 (FIG. 6) between lower shear edges 231 and 233 on posts 230, thereby separating the linking segment 98 (FIG. 2) from the band 90 at shear lines 132. As the shear assembly 68 continues downward, the strain relief shear 254 seats the strain relief 58 onto the dielectric member 78.

During the process of seating the strain relief 58, the shear edge 276 of the shield shear 256 passes into gap 232 (FIG. 6) between the posts 230. The shear edge 276 and lower shear edges 231 and 233 separate the linking segment 96 (FIG. 2) from the band 90 at shear lines 130. As the shear assembly 68 continues downward, the shield shear 256 seats the contact shield 56 on the dielectric member 78. Since the shear edges 274 and 276 are staggered along the shearing path A1, cuts are first performed at the shear lines 132. Thereafter, cuts are performed at shear lines 130. The bottom surface 272 of the strain relief shear 254 presses on top wall 114 to seat the strain relief 58 to a desired depth (e.g. depth D1 as shown in FIG. 4). The bottom surface 270 of the shield shear 256 presses on top wall 100 to seat the contact shield 56 to a desired depth (e.g. depth D2 as shown in FIG. 4). Finally, the shear assembly 68 is raised and the completed assembly is removed by pulling out the slide block 20.

The user loads slide block 20 with a new dielectric member 78 into the holder 66 and advances slide block 20. The cylinder 42 (FIG. 1) advances bracket 46 which in turn drives the feed finger 60 forward again along slot 62. A lower end of the feed finger 60 engages a corresponding hole 94 (FIG. 2) in the band 90 and advances the carrier strip 54 until a new contact shield 56 and strain relief 58 are properly located above the holder 66. By way of example only, the machine 10 may be used with coaxial cable which includes center contacts terminated on the central conductor of a prestripped coaxial cable.

The shearing assembly 68 affords a two-piece shear which enables the contact shields 56 and strain reliefs 58 to be cut and seated to different depths. The strain relief and shield shears 254 and 256 are independently adjustable through the depth adjusters 70 and 72 which affords detailed control over placement of the strain relief 58 and contact shield 56.

Optionally, the strip line machine 10 may operate only to attach contact shields, not strain reliefs, to the dielectric member. Alternatively, the strip line machine 10 may operate only to attach strain reliefs, not contact shields, to the cable.

Figure 8:
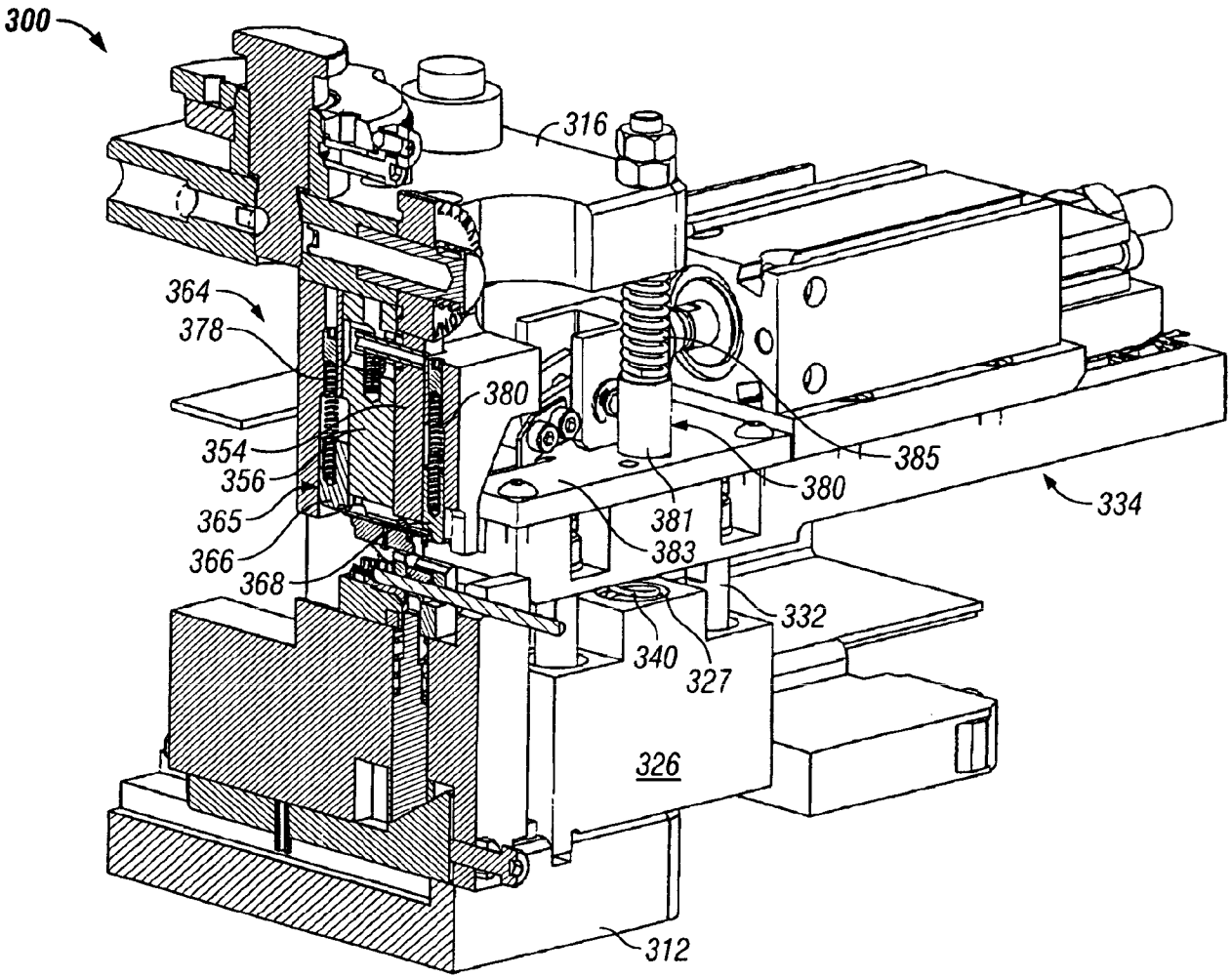
FIG. 8 illustrates a partial cutaway isometric view of a machine formed in accordance with an alternative embodiment of the present invention.

FIG. 8 illustrates a partial cut away isometric view of a machine 300 formed in accordance with an alternative embodiment. The machine 300 includes a strip guide 334 moveably mounted to a base 312. A guide support block 326 has been modified from guide support block 26 (FIG. 1) to include an interior cavity 327 that holds at least one spring 340 which abuts against the lower surface of the strip guide 334. Pins 332 extend upward from the guide support block 326 to support, and to guide, the strip guide 334 upward and downward along a desired path. The spring 340 biases the strip guide 334 to its uppermost position.

In addition, the machine 300 includes an alternative spring plunger 380 having a lower portion 381 arranged to abut against an upper surface 383 of the strip guide 334. The spring plunger 380 includes a central portion having a reduced diameter that receives a spring 385 thereon. The spring 385 biases the spring plunger 380 downward to its extended position from the top plate 316. As the top plate 316 is lowered, the spring 385 compresses as the spring plunger 380 forces the strip guide 334 downward.

The machine 300 further includes an alternative embodiment for the shear assembly 364. The shear assembly 364 includes a strain relief shear 354 and a contact shield shear 356. The strain relief and contact shield shears 354 and 356 are surrounded by a locator block 365 having end locator portions 366 and 368 that are pressed downward by springs 378 and 380, respectively.

Figure 9:
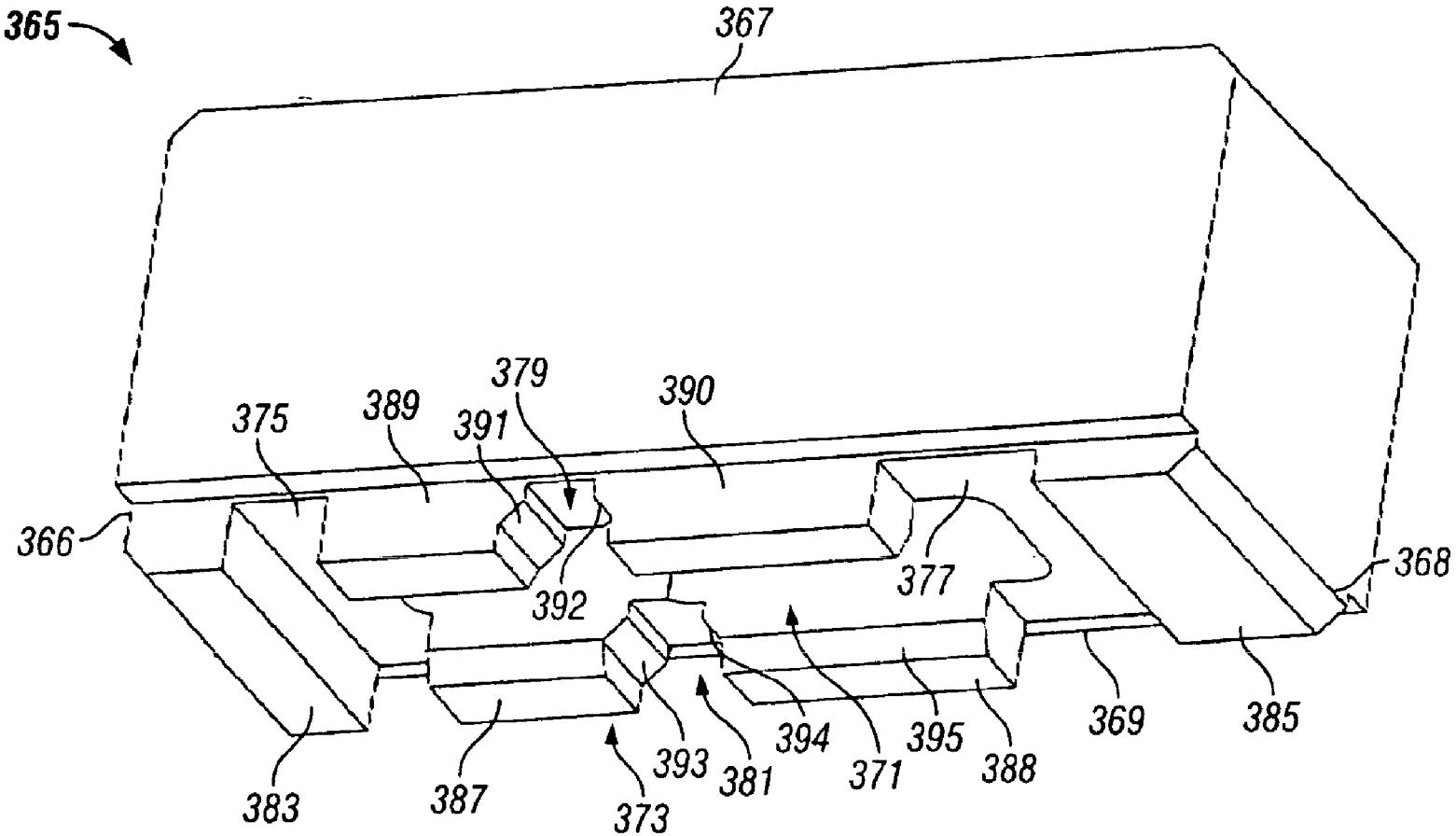
FIG. 9 illustrates a locator block held within the shearing assembly in accordance with an alternative embodiment of the present invention.

FIG. 9 illustrates the locator block 365 in more detail. The locator block 365 includes end locator portions 366 and 368 that are joined by side walls 367 and 369. A channel 371 extends through the locator block 365 to receive the strain relief and contact shield shears 354 and 356 (FIG. 8). A bottom face 373 of the locator block 365 includes a series of notches 375 and 377, and slots 379 and 381. The bottom face 373 includes raised platforms 383 and 385 forming opposite end locator portions 366 and 386, respectively. The raised platforms 383 and 385 are adjacent notches 375 and 377 that extend transversely between the side walls 367 and 369. Carrier locator brackets 389 390 are provided on the bottom face 373, are separated by slots 379 and include facing beveled surfaces 391 and 392. Carrier locator brackets 387 and 388 are separated by slot 381 at beveled facing surfaces 393 and 394. The interior edges of the carrier locator bracket 387–390 also include beveled surfaces 395 to better align and accept a strain relief 58 and a contact shield 56 during the assembly process. The carrier locator brackets 387–390 cooperate to align the contact shield 56 and strain relief 58 (FIG. 4) with the dielectric member 78 (FIG. 3) during assembly.

Figure 10:
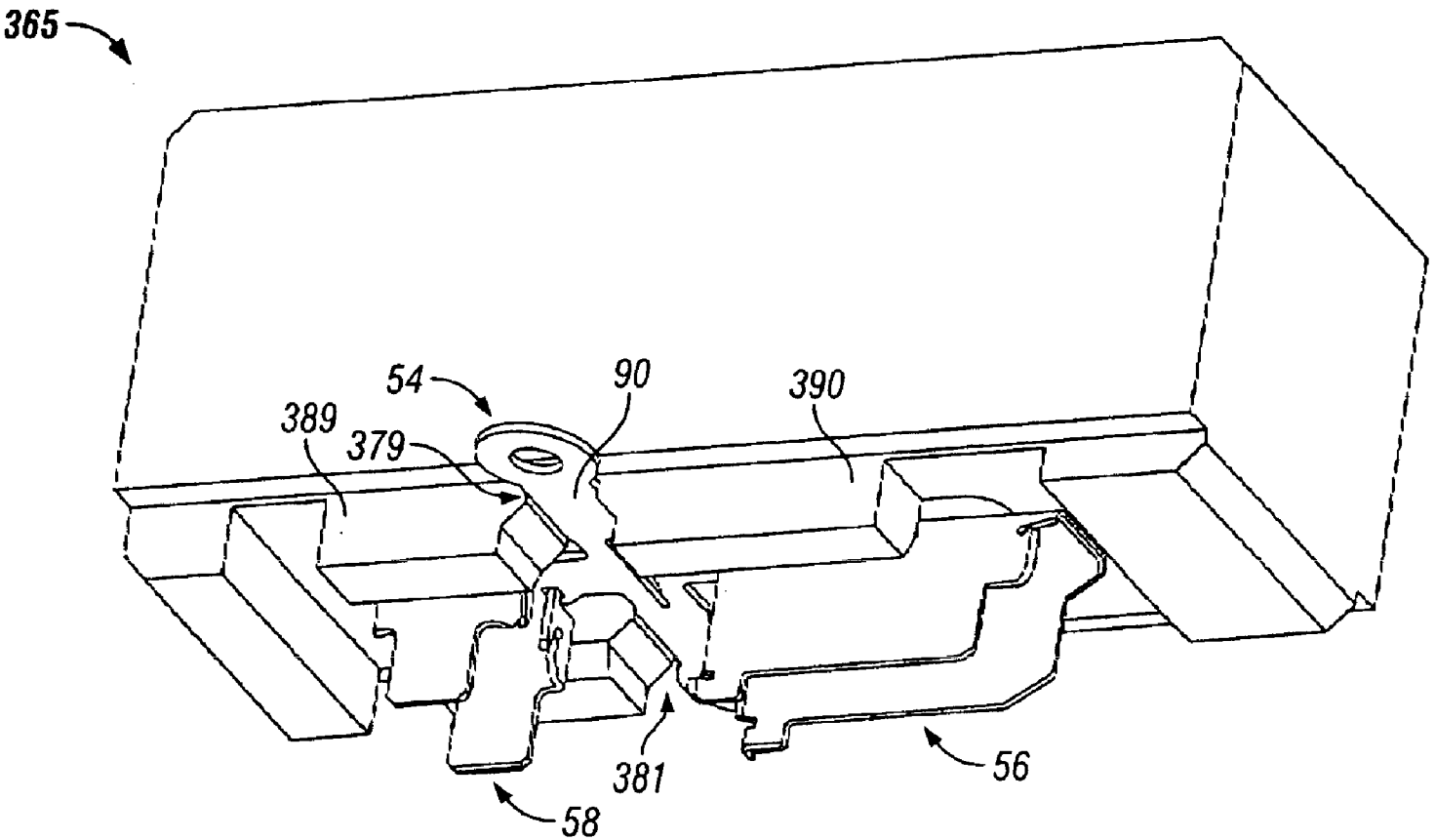
FIG. 10 illustrates an isometric view of a locator block containing a contact shield and strain relief in accordance with an alternative embodiment of the present invention.

FIG. 10 illustrates an isometric view of the locator block 365 with a contact shield 56 and strain relief 58 loaded therein. The band 90 of the carrier strip 54 is received within the slots 379 and 381 as the locator block 365 is moved downward with the shear assembly 364 (FIG. 8). Thus, the locator block 365 aligns the contact shield 56 and strain relief 58 within the shear assembly 364 (FIG. 8) by properly aligning and centering the carrier strip 54 at band 90.

While the invention has been described in terms of various specific embodiments, those skilled in the art will recognize that the invention can be practiced with modification within the spirit and scope of the claims.

What is claimed is:

1. An assembly for loading at least one of a contact shield and strain relief onto an end of a cable having a center conductor surrounded by insulation, the assembly comprising:

a strip guide configured to convey a carrier strip along a carrier path to a loading station, said strip guide being configured to accept the carrier strip with a series of contact shields and strain reliefs formed on the carrier strip; and a shear assembly movable to and from said loading station along a shearing path for removing separately each of the contact shields and each of the strain reliefs from the carrier strip.

2. The assembly of claim 1, wherein said shear assembly seats the contact shields and strain reliefs to different depths within a dielectric member.

3. An assembly for loading at least one of a contact shield and strain relief onto an end of a cable having a center conductor surrounded by insulation, the assembly comprising:

a strip guide configured to convey a carrier strip along a carrier path to a loading station, said strip guide being configured to accept the carrier strip with a series of contact shields and strain reliefs formed on the carrier strip; and a shear assembly movable to and from said loading station along a shearing path for removing the contact shields and the strain reliefs from the carrier strip, wherein said shear assembly includes first and second shears for separately removing the strain reliefs and contact shields, respectively, from the carrier strip.

4. The assembly of claim 1, further comprising a holder at the loading station, wherein said shear assembly includes first and second shears spaced different first and second distances from said holder within said shear assembly and being movable together toward said holder to successively engage said holder in a staggered manner.

5. The assembly of claim 1, wherein said strip guide includes a track configured to convey the series of contact shields and strain reliefs joined to the carrier strip along said carrier path.

6. The assembly of claim 1, further comprising a holder at the loading station, wherein said strip guide and holder are mounted adjacent one another to a base plate, said holder resisting movement along said shearing path, said strip guide being movable relative to said base plate in a direction parallel to said shearing path.

7. The assembly of claim 1, further comprising a locator post mounted to said shear assembly, said locator post aligning and centering the contact shield and a dielectric member with respect to one another, said shear assembly seating the contact shield onto the dielectric member.

8. The assembly of claim 1, further comprising a holder at the loading station, wherein said shear assembly includes a shear holder that retains first and second shear elements that are independently adjustable relative to said holder, said first and second shear elements having corresponding first and second shear edges that are positioned staggered with respect to one another.

9. The assembly of claim 1, further conspiring a holder at the loading station, wherein said strip guide includes a discharge end located proximate a side of said holder, said strip guide feeding the at least one of the contact shield and strain relief from said discharge end onto a top of said holder and onto a top of a dielectric member in said holder.

10. A machine, comprising:

a base;

a tooling nest mounted to said base, said tooling nest being configured to hold a dielectric member on an end of a cable, said tooling nest having an open face;

a strip guide moveably mounted to said base, said strip guide being configured to feed a carrier strip holding at least one of a contact shield and strain relief to said tooling nest; and an upper shear aligned over said open face of said tooling nest, said upper shear moving along a shearing path to engage said open face of said tooling nest, said upper shear being configured to separate individually a contact shield from the carrier strip and to separate individually a strain relief from the carrier strip at a shearing stage along said shearing path.

11. The machine of claim 10, wherein, after separating the carrier strip, said upper shear advances along said shearing path into said open face of said tooling nest beyond said shearing stage, to a seating stage at a predetermined seating depth within said tooling nest, said seating depth representing a depth to which at least one of the contact shield and strain relief are seated within the dielectric member.

12. The machine of claim 10, wherein said upper shear includes a shear frame holding a shield shear and a strain relief shear located adjacent one another, said shield and strain relief shears being movably mounted to said shear frame and adjustable to individually cut a contact shield and a strain relief, respectively, from the carrier strip at different times and in succession.

13. The machine of claim 10, wherein said upper shear includes first and second shear edges staggered with respect to one another along said shearing path, said first and second shear edges being configured to individually and successively separate a contact shield and a strain relief from the carrier strip as said upper shear is advanced along said shearing path.

14. The machine of claim 10, further comprising a U-shaped holder mounted to said base, said U-shaped holder including said tooling nest configured to receive a dielectric member, said upper shear engaging said holder to separate a contact shield and a strain relief from the carrier strip.

15. An assembly for loading a contact shield onto an end of a cable having a center conductor surrounded by insulation, the assembly comprising:

a strip guide for conveying a contact shield along a carrier path to a loading station, said contact shield being joined to a carrier strip;

a holder having a tooling nest formed therein that is configured to hold a dielectric member on an end of a cable;

a slider receiving said holder and moving said holder to and from said loading station along a cable loading path; and a shear assembly, provided at said loading station, for removing the contact shield from the carrier strip and for seating the contact shield along a seating path into a dielectric member held in said tooling nest.

16. The assembly of claim 15, wherein said shear assembly includes an upper shear and wherein said strip guide and upper shear are movable along a shearing path oriented at an angle to said carrier path.

17. The assembly of claim 15, wherein said strip guide includes a track configured to convey a series of contact shields joined to the carrier strip along said carrier path.

18. The assembly of claim 15, wherein said shear assembly includes first and second shears for separately removing a strain relief and the contact shield, respectively, form the carrier strip.

19. The assembly of claim 15, wherein said shear assembly includes first and second shears staged different first and second distances from said holder and being movable toward said holder to successively engage said holder in a staggered manner.

20. The assembly of claim 15, wherein said strip guide and slider are mounted adjacent one another to a base plate, said slider being movable relative to said base plate along said cable loading path, said strip guide being movable relative to said based plate along said seating path.

21. The assembly of claim 15, further comprising a locator post mounted to said shear assembly, said locator post aligning and centering the contact shield and dielectric member with respect to one another before the shear assembly presses the contact shield onto the dielectric member.

22. The assembly of claim 15, wherein said shear assembly includes a shear holder that retains first and second shear elements that are independently adjustable, said first and second shear elements having corresponding first and second shear edges that are stepped with respect to one another.

23. The assembly of claim 15, wherein said strip guide includes a discharge end located proximate a side of said holder, said strip guide feeding the contact shield from said discharge end onto a top of said holder and onto a top of the dielectric member in said holder.

* * * * *